United States Patent [19]

Marsh

[11] 4,311,273

[45] Jan. 19, 1982

[54] VARIABLE THICKNESS FABRIC MAT FOR RAILWAY TRACK STRUCTURE AND METHOD

[75] Inventor: Ronald P. Marsh, St. Louis, Mo.

[73] Assignee: True Temper Corporation, Cleveland, Ohio

[21] Appl. No.: 134,787

[22] Filed: Mar. 28, 1980

[51] Int. Cl.[3] ..... B32B 5/06; B32B 5/26; E01B 3/44

[52] U.S. Cl. ..... 238/1; 14/73; 238/2; 405/131; 405/258; 428/77; 428/172; 428/190; 428/212; 428/215; 428/220; 428/284; 428/287; 428/290; 428/311.5; 428/316.6

[58] Field of Search ..... 14/73; 238/1, 2; 104/1 R; 405/131, 258; 428/77, 172, 190, 212, 215, 220, 284, 287, 290, 317

[56] References Cited

U.S. PATENT DOCUMENTS

| | | | |
|---|---|---|---|
| 2,827,412 | 3/1958 | McKay | 428/77 |
| 3,402,227 | 9/1968 | Knee | 264/64 |
| 3,587,964 | 6/1971 | Cork | 238/1 |
| 3,598,680 | 8/1971 | Lee | 19/302 |
| 3,670,506 | 6/1972 | Goudard | 405/258 |
| 3,765,996 | 10/1973 | Munyon | 428/172 |
| 4,076,876 | 2/1978 | Bowles | 428/190 |
| 4,265,398 | 5/1981 | Luebke | 428/77 |

*Primary Examiner*—James C. Cannon
*Attorney, Agent, or Firm*—Baldwin, Egan, Walling & Fetzer

[57] ABSTRACT

A variable thickness fabric mat for use with railroad track right of way beneath the track structure. The mat has a central portion of predetermined thickness, and lateral shoulder portions of a reduced thickness as compared to said cental portion, with the central portion being of a predetermined width of adequate dimension to generally completely underlie the railroad track structure. The mat provides a method for transmission of force from a train on the railroad track structure to be spread over a greater area of the underlying earth bearing surface, and with the mat possessing the capability of passing water, and aiding in draining water from the soil beneath the mat, as well as from the top and sides of the track support.

28 Claims, 6 Drawing Figures

VARIABLE THICKNESS FABRIC MAT FOR RAILWAY TRACK STRUCTURE AND METHOD

This invention relates to general to a resilient mat adapted to underlie a railroad track structure along its right of way, for more uniformly distributing the loads from trains passing thereover to the underlying earth bearing area, and more particularly relates to a variable thickness, fabric mat adapted for underlying the railroad track structure along the right of way and wherein the thicker central portion thereof underlies the track structure, and thinner lateral shoulder portions of the mat extend laterally from such thicker portion. The mat in addition to more uniformly distributing the forces of a train moving on the track structure, to the underlying bearing soil areas, aids in drainage of water from the soil and from above the track support, and helps to stabilize poor support areas of soil. A method of utilizing the mat is also disclosed.

BACKGROUND OF THE INVENTION

Non-woven mats for use under roads and under railroad track structure along the right of way, are well known in the art. One such arrangement is disclosed in U.S. Pat. No. 3,670,506, dated June 20, 1972 and entitled "Process for Stabilizing Soils", and is directed to a method of utilizing non-woven fabric in poor support areas. Other prior publications include, for instance, an article entitled "Testing of Subgrade Stabilization Fabrics Moves Ahead" in the October 1976 publication of *Railway Track and Structures.* However, to applicant's knowledge, these prior art mats as used in the environments indicated are of generally uniform thickness throughout. Moreover, such prior art mats are generally one unitary member formed of a predetermined substantially uniform thickness of fabric material, and cut into predetermined lengths for use at the site.

Also in a pending U.S. patent application of Robert Luebke, Ser. No. 092,709, filed Nov. 9, 1979, now U.S. Pat. No. 4,265,398, there is disclosed a variable thickness fabric mat for use under railroad track crossings, switches and the like, which patent application is assigned to the assignee of the present application. Various prior publications including aforementioned U.S. Pat. No. 3,670,506 are identified in said Luebke application, and reference by incorporation is made thereto.

The present invention provides a novel variable thickness mat, adapted for use along a railroad track right of way beneath the track structure, so as to more uniformly distribute the force loads from a train to the underlying bearing support soil, and which will not impede drainage. The mat comprises a thicker central portion which underlies the track structure proper, thereby locating the thicker portion where it is most beneficial to the applied loads, and lateral shoulder portions of reduced thickness, as compared to the central portion, with such lateral shoulder portions projecting laterally beyond the confines of the track structure, and adapted to be covered by the ballast bed supporting the track structure.

Accordingly, an object of the invention is to provide a novel variable thickness mat for use along a railroad right of way beneath the track structure for more uniformly distributing the force loads applied to the track structure due to traffic thereover, to the underlying soil bearing areas, and which will not impede drainage, but instead will actually facilitate the latter.

Another object of the invention is to provide a mat of the aforementioned type which is formed of non-woven fabric.

A still further object of the invention is to provide a mat of the above described type which is comprised of a plurality of layers of fabric material, with means connecting the layers together, to form an integral mat member.

A still further object of the invention is to provide a mat of the aforementioned type which includes layers of non-woven fabric combined with at least one layer of woven fabric, together with means connecting the layers together into an integral mat member.

A further object of the invention is to provide a railroad track structure utilizing a mat of the aforediscussed type.

A still further object of the invention is to provide a method in a railroad track environment of reducing the stresses thereto utilizing a fabric mat underlying the railroad track structure.

Other objects and advantages of the invention will be apparent from the following description, taken in conjunction with the accompanying drawings wherein:

DESCRIPTION OF PREFERRED EMBODIMENTS

Figure 1:
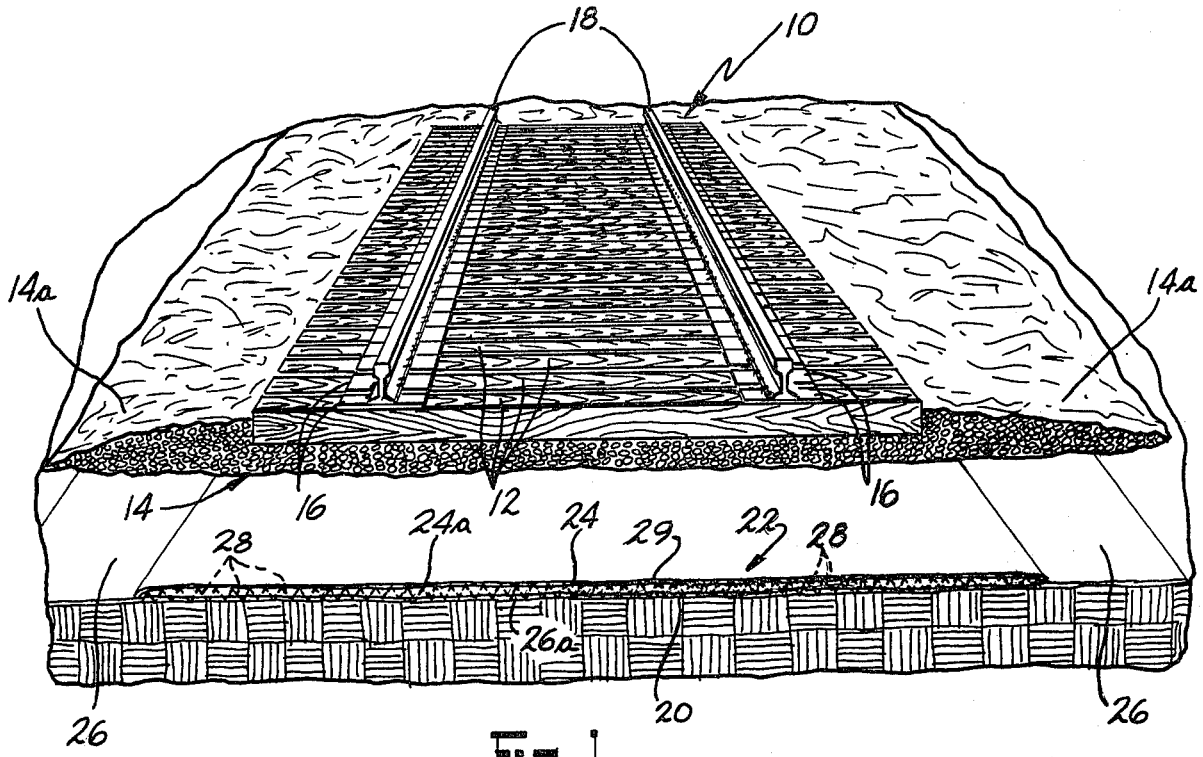
FIG. 1 is a generally perspective, transversely sectioned view of a railroad track structure utilizing the variable thickness mat of the present invention.

Referring now again to the drawings, there is illustrated in FIG. 1 a railroad right of way including track structure 10 comprising ties 12 supported on and embedded in ballast bed 14, with the ties, in the embodiment illustrated, supporting thereon conventional tie plates 16, on which are supported spaced rails 18. Any suitable means can be provided for anchoring or securing the rails and/or tie plates to the ties.

Normally, the ballast bed rests directly on a bearing ground surface 20 which has preferably been previously leveled, as by a bulldozer, track bed plow, undercutter, or the like, and which may or may not provide a good bearing surface. Many times tracks are laid through soft or wet soils which do not provide a good support for the track structure, and therefore, the forces applied to the track structure by the trains moving thereover can affect the track stability, cause undue wear and problems, fouled ballast, and including failure, in the track structure.

Accordingly, in order to attempt to stabilize the ground bearing surfaces and to more uniformly apply the force from the vehicles moving over the track structure, to the underlying soil bearing areas, it is known in the railroad field to use fabric mats including non-woven fabric mats beneath a layer of ballast so as to more evenly distribute the force loads to the bearing areas.

In accordance with this invention, the mat 22 underlying the track structure 100, comprises a thicker central or track portion 24 and thinner lateral shoulder portions 26 on both sides of the central portion. In the embodiment illustrated in FIG. 2 the mat 22 is formed of a plurality of layers of non-woven synthetic fabric material with the central portion 24 being partially formed of one layer 24*a* of fabric and the remainder of the central portion and the lateral shoulder portions 26 being formed of a further layer 26*a* of fabric, which layer 26*a* extends laterally of both sides of the top layer 24*a*. In this connection for purposes of underlying conventional United States gauge railroad track structure, the top layer 24*a* of the central portion may be approximately 90" to 110" in width, while the bottom layer 26*a* which includes the lateral shoulder portions, may be approximately 150" to 186" in width, with each of the lateral shoulder portions being in the range of from approximately two and one-half feet wide to a little over three feet in width. Means 28 (FIG. 2) is provided connecting or bonding the layers forming the mat 22, together. Such means comprises, in the embodiment illustrated, intertwined fibers of the various layers of fabric, which intertwined fibers are produced by needle punching of the layers, resulting in an integral mat member.

These mechanically interlocked fibers 28 due to the needle punching, may be produced in the conventional manner on needle looms, with the layers of fabric making up the mat being passed into the loom, and being connected as the needle barbs pass downwardly through the layers, interlocking engaged fibers of the mat into individual groups. The end results is a flexible layered, liquid pervious mat of high stability, with the layers thereof secured together by the punched fiber groups as diagrammatically illustrated in FIG. 2 at 28.

Chemical binders of suitable known type may also be utilized between the layers of the mat, for aiding in connecting the layers together. For most purposes, however, and for the purposes of underlying railroad track structure with which the present product is particularly applicable, needle connecting or bonding is adequate, and is preferred, and chemical binders for attaching the mat layers 24*a*, 26*a* together are not necessary or even desirable, since such chemical binders may adversely effect the permeability of the mat.

Non-woven fabrics for use in the construction and railroad industries are well known, with such fabrics as aforementioned being utilized in the construction industry for the laying of the automotive roadways as well as in railroad track routes. These known fabrics which are made from a plurality of materials, such as for instance from polyesters, are available from a plurality of companies, including the assignee of the instant invention.

The mats are expeditiously utilizable with poor load bearing soils and form an effective resilient support bed for the railroad track structure in such an environment, to help support and spread the forces from wheeled traffic over the track structure, to the underlying ground bearing area. The mats readily pass runoff water and facilitate the drainage of the water from the railway right of way without impeding drainage. Such drainage is facilitated by the mat 22 from the top of the ballast bed 14 down through the bed, as well as laterally or horizontally through the mat. The lateral shoulder portions 26 of the mat 22 underlying the shoulders 14*a* of the ballast bed aid in anchoring the bed in place as well as facilitating drainage of ground water laterally through the mat and from the overlying ballast bed. The mats also actually facilitate by surface tension, the passage of ground water from the underlying bearing ground surface 20, and filter out fine soil particles that might otherwise contaminate the track ballast, thus aiding in maintaining good drainage in the ballast bed, and improved stability of the bearing ground surface.

Figure 2:
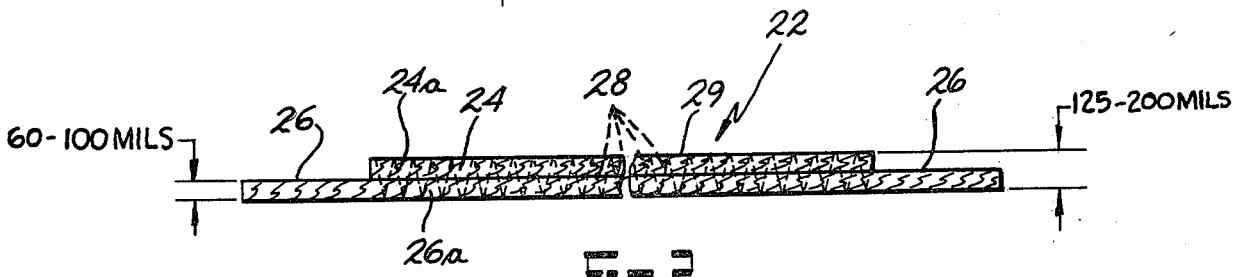
FIG. 2 is a generally diagrammatic, broken, elevational view illustrating the variable thickness mat utilized in the railroad track structure of FIG. 1.

In the mat structure illustrated in FIGS. 1 and 2, the central track portion 24 is preferably of from about 125 mil to 200 mil thickness, and the lateral shoulder portions are preferably of about 60 to 100 mil thickness. As shown in FIG. 1, the ballast bed 14 preferably fully covers the lateral shoulder portions 26 of the mat.

Layer 24*a* of the mat is preferably saturated by any suitable means, such as by dipping or spraying, with a synthetic resin-like binder, such as for instance a thermosetting self cross linking acrylic co-polymer emulsion (e.g. Nacryl No. 977 obtainable from Derby Chemical Company of Ashland, Mass.) Thereafter the layer 24*a* of needle punched non-woven material and binder is subjected to a blast of air operable to drive off the excess binder, and then is oven dried at suitable temperature, to set the resin-like material dispersed throughout the fibers of layer 24*a*. Such a resin-like impregnating treatment of the non-woven fabric layer 24*a* does not materially affect the permeability of the fabric to fluid flow, but does substantially increase the tensile strength of the fabric of the mat, as well as increasing the abrasion resistance of the layer 24*a*.

Thereafter layer 24*a* is passed through the loom together with aforementioned layer 26*a*, and is needle punched by the needle barbs of the loom, to mechanically bond or connect layers 24*a*, 26*a* together into an integral mat. While layer 26*a* of the mat could also be impregnated with a resin-like binder material, the latter is not required, and the economics of the situation generally dictates that such not be done.

Figure 6:
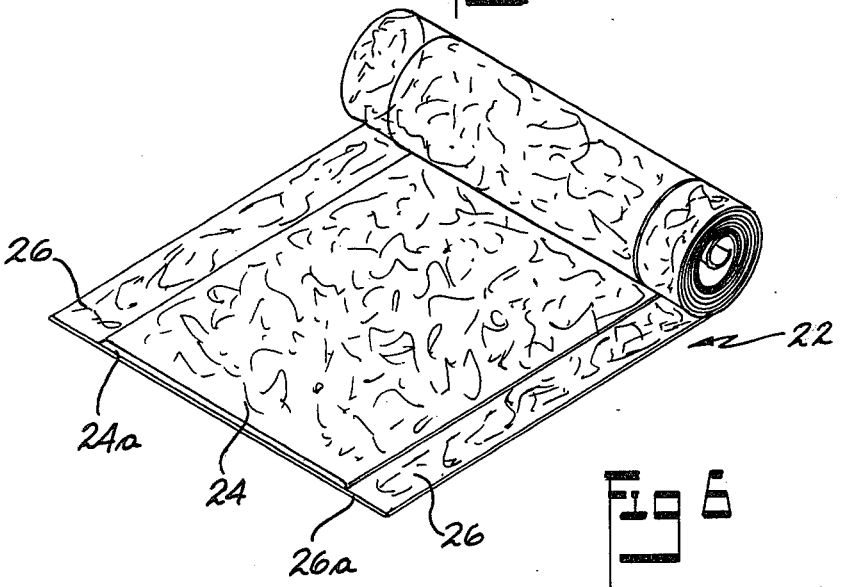
FIG. 6 is a perspective, reduced size illustration of a roll of the mat material, for convenient use on site installation.

The finished mat may be provided in any desired lengths. For ease of handling and storage and ease of applying the mat to the railway track, lengths of approximately 300 feet have been found to be convenient and can be rolled, and dropped off at the site of use (FIG. 6) for expeditious handling in laying on the bearing ground surface that has been prepared, such as for instance by leveling, prior to the placing of a layer or bed 14 of ballast thereover. Also such mats can be inserted under existing track structure by the use of the aforementioned undercutter and track bed plow devices, by undercutting an existing track bed and track and inserting the fabric material under the track structure, while the latter is in raised condition, and then redepositing the ballast bed thereon and then lowering the track structure. Such undercutting and ballast redepositing procedures are known in the railway track art.

The choice of the denier per filament or fiber used in the non-woven fabric is governed primarily by the requirements of the end product. However, a denier in the range of 3–9 is preferred for use in the FIG. 2 mat of the invention. In the embodiment of mat illustrated, the fibers from which the mat is formed are of non-continuous or cut type, preferably possessing a length of approximately 3–4 inches. However continuous fibers could also be utilized in formation of the fabric from which the mats are formed. In any event, in the mat of FIG. 2, layer 24*a* thereof defining in part center portion 24, preferably possesses a weight of approximately 8 to 12 oz. per square yard (this includes the weight of the resin-like binder), while layer 26a which defines shoulder portions 26 preferably possesses a weight of approximately 4 to 6 oz. per square yard.

The following is a table which lists various typical physical characteristics of a polyester fabric mat of the FIG. 2 type embodiment.

| PROPERTY | VALUE | | TEST METHOD |
|---|---|---|---|
| Composition | 100% of Polyester Fiber | | |
| Construction | Needle Punch Bonding, Variable Thickness Fabric (Binder Impregnation of Track Section of Mat) | | |
| | Shoulder | Track | |
| Grab Tensile, lbs | 80 | 175 | ASTM D-1682 (American Society of Testing Mat'ls.) |
| Grab Elongation, % | 125 | 100 | ASTM D-1682 |
| @ 10 lbs, % | 40 | 5 | |
| @ 25 lbs, % | 70 | 20 | |
| Trapezoid Tear, lbs | 50 | 100 | ASTM D-2263 |
| Mullen Burst, lbs | 175 | +300 | Mullen Test |
| Thickness, mils | 100 | 125 | ASTM D-1777 |
| Width, inches | 30–30 | 90 | |
| Abrasion Resistance (CS 17 Wheel, % Grab Strength Retained - 1000 gm weight, 1000 gm weight, 1000 cycles) | 50 | 75 | Tabor Test ASTM D-1175 |
| Puncture Resist. lbs | 50 | 140 | ASTM D-751 |
| $EOS_{D50}$ U.S. Std. Sieve Sizes | 70 mesh | 140 mesh | Corps. of E. Test |
| Air Perm. cfm | 250 | 150 | ASTM D-737 |

The non-woven synthetic fabrics used in the mat are preferably resistant to attacks by the components normally found in soils and in ground water, and aid in maintaining the ballast layer 14 free of fluids and well drained, any such fluid readily draining both laterally and vertically through the mat. The various layers of the mats may be formed of a polyester which is a stable, long-lived polymer, and preferably is of such porosity that the mat will hold back particles larger than about 70 microns, while generally permitting smaller water born fines to pass through without clogging or binding the fabric.

Figure 3:
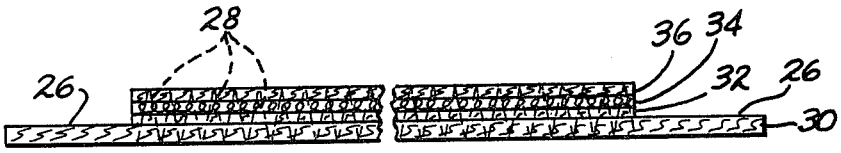
FIG. 3 is a generally diagrammatic broken, elevational view illustrating another embodiment of mat.

Referring now to FIG. 3, there is illustrated another embodiment of pad or mat for use beneath railroad track structure. In this embodiment, a plurality of stacked fabric layers 30, 32, 34, 36 are provided, with the bottommost layer 30 comprising the shouldered portions 26 of the mat. In this embodiment, layers 30, 32 and 36 are formed of non-woven synthetic fabric material such as for instance from the aforementioned polyester, while layer 34 may be a relatively heavy denier monofilament synthetic fabric layer, providing a relatively large void section in the mat, thereby facilitating greater drainage of ground water laterally or horizontally through the mat. The heavy denier could be of the order of 10 to 20 denier for the monofilament fiber.

The various layers 30, 32, 34 and 36 are connected together into an integral mat, such as for instance by means of the aforementioned needle punching, as illustrated diagrammatically at 28, and in a similar manner as in the fabrication and connecting of juxtaposed layers of the mat of FIG. 2.

The layers 32, 34 and 36 of the FIG. 3 mat may be impregnated with a resinous binder in the same manner as aforedescribed in connection with layer 24a of the FIG. 2 mat, which provides considerable abrasion resistance to the impregnated mat material, as well as increased tensile strength. Such resin-like binder material is preferably applied to the respective mat layer subsequent to the needle punching thereof to form the layer, but prior to the needle punching of the various layers to form the integral mat structure.

The mat embodiment of FIG. 3 may be particularly useable where the ground support areas encompass considerable surface water, so that the water can more rapidly flow through the mat with reduced obstruction, and especially through the monofilament layer 34. The porosity of the other layers and denier of the filaments thereof may be generally similar to that aforedescribed in connection with the layers of the FIG. 2 mat embodiment.

Figure 4:
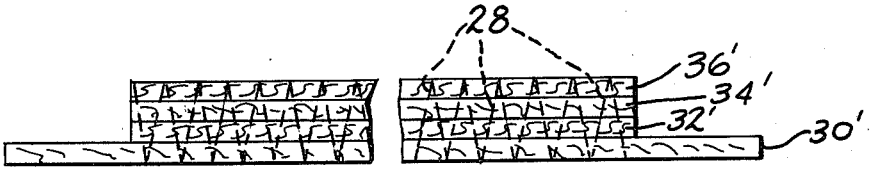
FIG. 4 is a view generally similar to FIG. 3, but illustrating a still further embodiment of mat.

Referring now to FIG. 4, there is illustrated a further embodiment of mat structure. In this embodiment, the non-woven fabric layers 30', 32', 34' and 36' are of variable denier. For instance, layer 30' could be of between 1 to 3 denier per filament while layer 32' could be of between approximately 3 to 5 denier per filament, thus providing a greater strength to layer 32' as compared to layer 30'. Layer 34' could be of 5 to 10 denier per filament, while layer 36' could likewise be of 5 to 10 denier per filament, all of such layers being formed for instance from polyester filament. Also in this embodiment, the various layers 32', 34' and 36' may be impregnated with a resin-like binder as aforedescribed for FIGS. 2 and 3 providing improved tensile strength and abrasion resistance to the central portion of the mat during its use beneath railroad track structure.

Figure 5:
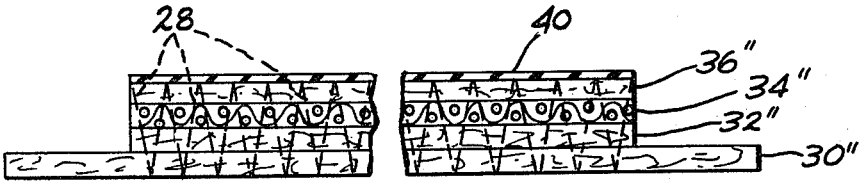
FIG. 5 is a view generally similar to FIGS. 3 and 4, but illustrating a still further embodiment of mat.

Referring to FIG. 5, there is illustrated a further embodiment of mat structure. In this embodiment, layers 30", 32" and 36" may be generally similar to the correspondingly numbered layers (except for the suffix prime) in the FIG. 3 embodiment. However, layer 34" in this embodiment comprises a woven synthetic fabric (as opposed to a non-woven synthetic fabric). Such woven layer may be formed of any suitable synthetic material, including polyester, and provides for strength reinforcement of the mat, and also increases its resistance to puncture. Also in this embodiment, the top surface of the uppermost layer 36" may be coated with an abrasion resistance non-apertured coating 40, such as for instance rubber, or plastic, or any other suitable material. Such a coating is adapted to resist wear and/or puncturing by the overlying ballast bed, and may be applied by spraying or by suitable adhesive means, or any other suitable means to provide a good attachment to the underlying confronting top surface of layer 36" of the mat. While coating 40 will substantially prevent the passage of water vertically down through the mat, it has practically no effect on water passage horizontally through the mat, and/or upwardly into the mat from the underlying ground surface 20.

In all of these various embodiments of mats, it will be seen that they provide a generally resilient support for the railroad track structure, and more uniformly distribute the forces applied to the track structure by vehicles moving thereover, to the underlying ground support surfaces thus aiding in equalizing and reducing the stresses applied to the track structure itself. Moreover, these various mat structures actually increase the elimination of water from the underlying and adjacent ground bearing surfaces and the ballast bed, to thereby aid in stabilizing the ground bearing surfaces, and thereby further aiding in reducing stresses applied to the track structure by traffic moving thereover.

From the foregoing discussion and accompanying drawings it will be seen that the invention provides a novel variable thickness mat adapted for use beneath a railroad track structure, for distributing the load on the track structure over increased area, and a mat structure which includes a thicker central portion adapted to underlie the railroad track structure per se, and lateral shoulder portions of reduced thickness, which are adapted to project laterally outwardly from the thicker central portion, and to underlie the ballast bed.

The invention also provides a mat of the above type in conjunction with railroad track structure, for alleviating stresses applied to the track structure and for improving the condition of the ground bearing surfaces areas which support the track structure, and particularly being operable to improve poor bearing surfaces which have water problems associated therewith.

The invention also provides a novel method of utilizing the mat and more evenly distributing the load from a railroad track and its associated ballast bed, along the railroad track right of way.

The terms and expressions which have been used are used as terms of description, and not of limitation, and there is no intention in the use of such terms and expressions of excluding any equivalents of any of the features shown, or described, or portions thereof, and it is recognized that various modifications are possible within the scope of the invention claimed.

What is claimed is:

1. A method of providing for spreading of the load due to wheeled traffic on a railroad track structure, comprising the steps of placing a variable thickness, elongated, integral, liquid pervious fabric mat of selected length on the earthern support surface so as to cover a selected length of the latter along the railroad right of way, placing a layer of ballast including sloping shoulder portions on said mat and placing the track structure including the ties and the rails on the ballast layer, extending lengthwise of the underlying mat in general alignment therewith, with said mat being of sufficient width so as to substantially completely underlie the transverse extent of the track structure including the ties and the rails, with the mat comprising a thicker central portion where it directly underlies said track structure and thinner lateral portions projecting laterally outwardly beyond said transverse extent of said track structure, said central portion of said mat being of predetermined width and of selected and substantially uniform thickness throughout its length, each of said lateral portions being of lesser thickness and width as compared to the respective thickness and width of said central portion, but being of substantially the same length as said central portion, said mat comprising a plurality of stacked, generally equal length individual layers of fabric material connected together into an integral member and being porous so as to readily pass liquid therethrough but being of such porosity as to prevent the passage of soil particles greater than a predetermined size therethrough, to thereby aid in preventing contamination of said ballast layer, the shoulder portions of said ballast layer overlying and resting on said lateral portions of said mat, said mat extending lengthwise in general alignment with the lengthwise extension of said track structure and said lateral portions being disposed generally laterally of the vertical planes defining the side confines of the track structure and beneath said shoulder portions of said ballast layer.

2. A method in accordance with claim 1 wherein said mat comprises a plurality of individual layers of nonwoven fabric material with means mechanically connecting the layers together into an integral mat member.

3. A method in accordance with claim 2 wherein at least part of said thicker portion of said mat is impregnated with a resin-like binder material which increases the tensile strength of the mat.

4. A method in accordance with claim 1 including providing the mat in roll form, and unrolling it to said selected length on the earthern support surface for disposal beneath the layer of ballast and the track structure.

5. A variable thickness, elongated, integral synthetic fabric mat pervious to liquid and which includes nonwoven needle punched fabric material, adapted for use beneath a railroad track structure lengthwise of the latter for spreading the load on the track structure over an increased area, said mat comprising a plurality of stacked, generally equal length individual layers of fabric material connected together into an integral member, and being of selected length and comprising a central portion of predetermined width and of selected and substantially uniform thickness throughout its length and lateral portions on both sides of said central portion, each of said lateral portions being of lesser thickness and width as compared to the respective thickness and width of said central portion but being of substantially the same length, said central portion being adapted to extend lengthwise of the track structure beneath the latter with said lateral portions being adapted to be disposed generally laterally outwardly of the vertical planes defining the side confines of the track structure.

6. A mat in accordance with claim 5 wherein said central portion is within the range of approximately 125 to 200 mil thickness and said lateral portions are each within a range of approximately 60 to 100 mil thickness.

7. A mat in accordance with claim 5 which is formed of non-woven polyester fiber.

8. A mat in accordance with claim 5 wherein said central portion includes an abrasion resistant coating on its upper surface.

9. A mat in accordance with claim 5 wherein at least said central portion of said fabric mat has been saturated with a resin-like binder and then subsequently dried.

10. A mat in accordance with claim 5 wherein said means connecting the layers together comprises interlocked fibers from the various layers produced by simultaneous needle punching of juxtaposed individual layers of the mat.

11. A mat in accordance with claim 5 wherein said central portion is of a heavier weight per square yard as compared to the weight per square yard of said thinner lateral portions.

12. A mat in accordance with claim 5 wherein certain of said layers comprises nonwoven needle punched fabric and another of said layers comprises a monofilament fabric, the means connecting the layers together comprising interlocked fibers from the various layers produced by needle punching of juxtaposed layers.

13. A mat in accordance with claim 5 wherein the top surface of said central portion of said mat comprises a layer of abrasion resistant generally non-pervious material, such as for instance rubber.

14. A mat in accordance with claim 5 wherein the grab tensile strength of the central portion of the mat is approximately 175 pounds and the grab tensile strength of the lateral shoulder portions of the mat is approximately 80 pounds.

15. A mat in accordance with claim 5 wherein the central portion has a Mullen burst strength of approximately 300 plus pounds, and said lateral portions of approximately 175 pounds.

16. A mat in accordance with claim 5 wherein said central portion has a puncture resistance of approximately 140 pounds and said lateral portions have a puncture resistance of approximately 50 pounds.

17. A mat in accordance with claim 5 wherein said central portion has an air permeability of approximately 150 cubic feet per minute and said lateral shoulder portions have an air permeability of approximately 250 cubic feet per minute as measured by ASTM D-737.

18. A mat in accordance with claim 5 wherein the width of said central thicker portion is between approximately 90 to 110 inches with the overall width of said mat being between approximately 150 to 186 inches and with said thinner lateral portions each being between approximately two and one half to a little over three feet in width.

19. A mat in accordance with claim 18 which is approximately 300 feet in length.

20. A mat in accordance with claim 5 wherein at least one of said plurality of layers of fabric material, connected together into an integral member, is of a different type of fabric material and possesses a greater liquid permeability as compared to the other of said layers.

21. A mat in accordance with claim 5, wherein the mat comprises at least three stacked layers and the fibers of one of said layers are between approximately 1 to 3 denier, while the fibers of another of said layers are between approximately 5 to 10 denier, and the fibers of another of said layers are between approximately 3 to 5 denier.

22. A mat in accordance with claim 5 wherein one of said layers comprises synthetic woven fabric and the means connecting the layers together comprises interlocked fibers from the various layers produced by needle punching of the layers when the latter are juxtaposed in said stacked condition.

23. In combination with a railroad track structure, including spaced ties, a non-woven, needle punched, liquid pervious, elongated integral fabric mat disposed beneath said structure and extending along beneath said structure lengthwise thereof for a predetermined distance, to provide a generally resilient base for the track structure, a layer of ballast disposed on top of said mat and supporting thereon the ties of the railroad track structure, said mat comprising a plurality of stacked, generally equal length individual layers of fabric material connected together into an integral member, and including a central portion of predetermined width and of selected and substantially uniformed thickness throughout its length and lateral shoulder portions on both sides of said central portion of a thinner thickness and lesser width as compared to the respective thickness and width of said central portion, said central portion being disposed beneath said track structure so as to generally completely underlie the transverse dimension of said track structure, with said lateral shoulder portions extending extending lengthwise generally the same length as said central portion and projecting laterally outwardly of the vertical planes defining the side confines of said track structure, and being covered by said ballast layer.

24. The combination in accordance with claim 23 wherein at least said central portion of said mat is impregnated with a binder material which increases the tensile strength of said mat.

25. The combination in accordance with claim 23 wherein said non-woven fabric is formed of polyester fiber.

26. The combination in accordance with claim 23 wherein said mat comprises a plurality of stacked, individual fabric layers, with certain of said layers being formed of non-woven needle punched fabric and other of said layers being formed of other type fabric.

27. The combination in accordance with claim 23 wherein said mat comprises a plurality of individual layers of non-woven needle punched polyester fabric material, and the means connecting said layer together into an integral member comprises interlocked fibers from the various layers produced by needle punching of the layers when the latter are juxtaposed in said stacked condition, at least the upper layer of said mat comprising said central portion, being impregnated with a resin-like binder material which increases the tensile strength of said mat.

28. The combination in accordance with claim 23 wherein the means connecting the layers together comprises interlocked fibers from the various layers produced by needle punching of the layers when juxtaposed in said stacked condition.

* * * * *

UNITED STATES PATENT AND TRADEMARK OFFICE

CERTIFICATE OF CORRECTION

PATENT NO. : 4,311,273

DATED : January 19, 1982

INVENTOR(S) : Ronald P. Marsh

It is certified that error appears in the above—identified patent and that said Letters Patent is hereby corrected as shown below:

Column 3, line 4, "100" should read -- 10 --.

Column 3, line 35, "results" should read -- result --.

Signed and Sealed this

*Thirteenth* Day of *April 1982*

[SEAL]

*Attest:*

GERALD J. MOSSINGHOFF

*Attesting Officer*

*Commissioner of Patents and Trademarks*